US007338916B2

(12) United States Patent
Rollin, Jr.

(10) Patent No.: US 7,338,916 B2
(45) Date of Patent: Mar. 4, 2008

(54) FLASH SPUN SHEET MATERIAL HAVING IMPROVED BREATHABILITY

(75) Inventor: Paul E. Rollin, Jr., Gallatin, TN (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 186 days.

(21) Appl. No.: 11/087,314

(22) Filed: Mar. 23, 2005

(65) Prior Publication Data

US 2006/0084346 A1 Apr. 20, 2006

Related U.S. Application Data

(60) Provisional application No. 60/558,289, filed on Mar. 31, 2004.

(51) Int. Cl.
*B32B 5/16* (2006.01)
*D04H 3/00* (2006.01)

(52) U.S. Cl. ..... 442/365; 442/340; 442/414

(58) Field of Classification Search ..... 442/417, 442/340, 365, 414
See application file for complete search history.

(56) References Cited

U.S. PATENT DOCUMENTS

| | | | |
|---|---|---|---|
| 3,081,519 | A | 3/1963 | Blades et al. |
| 3,169,899 | A | 2/1965 | Steuber |
| 3,227,794 | A | 1/1966 | Anderson et al. |
| 3,860,369 | A | 1/1975 | Brethauer et al. |
| 5,512,357 | A | 4/1996 | Shimura et al. |
| 5,603,885 | A | 2/1997 | McGinty |
| 6,010,970 | A | 1/2000 | McGinty et al. |

*Primary Examiner*—Jenna-Leigh Johnson

(57) ABSTRACT

A process is disclosed for flash spinning a nonwoven fibrous sheet from a polymeric solution containing about 12% to 33% by weight of filler particles. The filler is preferably insoluble in the polymer. The resulting plexifilamentary film-fibril sheet material has increased breathability with no decrease in liquid barrier.

2 Claims, No Drawings

FLASH SPUN SHEET MATERIAL HAVING IMPROVED BREATHABILITY

BACKGROUND OF THE INVENTION

1. Field of the Invention

The present invention relates to the preparation of non-woven fibrous sheet materials containing filler materials and a process for making said sheet.

2. Description of the Related Art

Plexifilamentary sheet material containing fillers is known. U.S. Pat. No. 3,081,519 (Blades et al.) and U.S. Pat. No. 3,169,899 (Steuber) disclose the addition of common textile additives such as dyes, pigments, antioxidants, delusterants, antistatic agents, reinforcing particles, removable particles, and U.V. stabilizers to the polymer used in a process for forming fibrillated strand materials. U.S. Pat. No. 5,512,357 (Shimura et al.) discloses a process for making a plexifilamentary fiber involving adding 0.1 wt % to 11 wt % of a spreading agent to the polymer. The spreading agent may be a nucleating agent, a lubricant or a crystalline resin except a base resin. U.S. Pat. No. 6,010,970 (McGinty et al.) discloses a sheet material flash spun from polyolefin and a pigment wherein the pigment comprises between 0.05 wt % and 10 wt % of the flash spun fibril strands. The pigment is added to increase the opacity of the flash spun sheet.

The art of flash-spinning plexifilamentary film-fibrils from a polymer in a solution or a dispersion is known in the art. The term "plexifilamentary" means a three-dimensional integral network of a multitude of thin, ribbon-like, film-fibril elements of random length and with a mean thickness of less than about 4 micrometers and with a median fibril width of less than about 25 micrometers. In plexifilamentary structures, the film-fibril elements are generally coextensively aligned with the longitudinal axis of the structure and they intermittently unite and separate at irregular intervals in various places throughout the length, width and thickness of the structure to form the three-dimensional network.

The process of forming plexifilamentary film-fibril strands and forming the same into non-woven sheet material has been disclosed and extensively discussed in U.S. Pat. No. 3,081,519 to Blades et al.; U.S. Pat. No. 3,227,794 to Anderson et al.; U.S. Pat. No. 3,169,899 to Steuber; U.S. Pat. No. 3,860,369 to Brethauer et al.; and U.S. Pat. No. 5,603,885 to McGinty (all of which are assigned to DuPont). This process and various improvements thereof have been practiced by DuPont for a number of years in the manufacture of its TYVEK® spunbonded olefin.

The polymers that have been conventionally used in production of flash-spun plexifilamentary sheets are polyolefins, especially polyethylene. The term "polyethylene" is intended to embrace not only homopolymers of ethylene but also copolymers wherein at least 85% of the recurring units are ethylene units. A preferred polyethylene polymer is a homopolymeric linear polyethylene, which has an upper limit of melting range of about 130° to 135° C., a density in the range of 0.94 to 0.98 g/cm3 and a melt index (as defined by ASTM D-1238-57T, Condition E) of 0.1 to 6.0. Polypropylene is another polyolefin that can be used to make sheet material for use in packaging applications requiring higher temperature sterilization processes such as steam sterilization.

Unfortunately, it is difficult to maintain good sheet breathability in a spunbonded sheet with high liquid barrier and good physical properties. Known processes for effecting higher breathability also result in lower liquid barrier. Some end uses in protective apparel, such as medical fabrics, require a combination of good breathability and high liquid barrier. It is important for the material used in a medical gown to breathe to provide comfort for the wearer, however, it is also important for the material to resist the flow of fluids through the medical gown to the wearer.

Accordingly, there is a need for a sheet material having improved breathability without undergoing a significant reduction in the physical properties and/or the liquid barrier of the sheet.

DETAILED DESCRIPTION OF THE INVENTION

Definition of Terms

The term "polymer" as used herein, generally includes but is not limited to, homopolymers, copolymers (such as for example, block, graft, random and alternating copolymers), terpolymers, etc., and blends and modifications thereof. Furthermore, unless otherwise specifically limited, the term "polymer" shall include all possible geometrical configurations of the material. These configurations include, but are not limited to isotactic, syndiotactic, and random symmetries.

The term "polyolefin" as used herein, is intended to mean any of a series of largely saturated polymeric hydrocarbons composed only of carbon and hydrogen. Typical polyolefins include, but are not limited to, polyethylene, polypropylene, polymethylpentene, and various combinations of the monomers ethylene, propylene, and methylpentene.

The term "polyethylene" as used herein is intended to encompass not only homopolymers of ethylene, but also copolymers wherein at least 85% of the recurring units are ethylene units such as copolymers of ethylene and alpha-olefins. Preferred polyethylenes include low-density polyethylene, linear low-density polyethylene, and linear high-density polyethylene. A preferred linear high-density polyethylene has an upper limit melting range of about 130° C. to 140° C., a density in the range of about 0.941 to 0.980 gram per cubic centimeter, and a melt index (as defined by ASTM D-1238-57T Condition E) of between 0.1 and 100, and preferably less than 4.

The term "polypropylene" as used herein is intended to embrace not only homopolymers of propylene but also copolymers where at least 85% of the recurring units are propylene units. Preferred polypropylene polymers include isotactic polypropylene and syndiotactic polypropylene.

The term "plexifilament" as used herein, means a three-dimensional integral network or web of a multitude of thin, ribbon-like, film-fibril elements of random length and with a mean film thickness of less than about 4 microns and a median fibril width of less than about 25 microns. In plexifilamentary structures, the film-fibril elements intermittently unite and separate at irregular intervals in various places throughout the length, width and thickness of the structure to form a continuous three-dimensional network.

The terms "plexifilamentary film-fibril strand material," "plexifilamentary web," "flash spun web," and "flash spun sheet" are used herein interchangeably to refer to a plexifilamentary film-fibril web material.

The term "spin agent" is used herein to refer to a volatile fluid in a polymeric solution capable of being flash spun.

The nonwoven sheet of the invention is preferably a flash spun nonwoven. The sheet may be made according to the process disclosed in U.S. Pat. No. 3,860,369 to Brethauer et al., which is hereby incorporated by reference.

Description

The present invention is directed to a gas permeable spunbonded plexifilamentary sheet material. Namely, the sheet of the invention is a spunbonded plexifilamentary sheet material having a combination of higher gas permeability and higher liquid (water) barrier than traditional spunbonded plexifilamentary sheet material. In addition, the spunbonded plexifilamentary sheet material of the invention has good physical properties.

The improved spunbonded plexifilamentary sheet material of the invention is made from a thermoplastic polymer with a moderate amount of filler dispersed throughout the polymer. The spunbonded plexifilamentary sheet is produced by flash-spinning.

Typical polymers used in the flash-spinning process are polyolefins, such as polyethylene and polypropylene. It is also contemplated that copolymers comprised primarily of ethylene and propylene monomer units, and blends of olefin polymers and copolymers could be flash-spun. It has been found that it is possible to make flash-spun polyolefin sheet material according to the processes described above, but with a moderate amount of filler dispersed throughout the polymer. Such filler has been found to increase the breathability of the flash-spun sheet. It has also been found that the breathability is improved without reducing the liquid barrier or the physical properties of the sheet. This is very beneficial when the sheet material will be used in end use applications of protective apparel requiring a combination of high air permeability or breathability and high liquid barrier (hydrostatic head or hydrohead). Such end use applications include, for example, medical garments.

Fillers for use in the invention have a diameter between about 0.2 and 10 micrometers, preferably between 1 and 5 micrometers. The particles useful in the invention preferably have a spherical shape.

In this invention, the filler particles used are preferably incompatible with the polymer. By "incompatible" is meant that the particles have a tendency to phase separate on flashing when mixed with the polymer. However, the filler particles may be coated with a compatibilizer, such as, stearic acid to make the filler well dispersed in or compatible with the polymer of the film-fibril strands of the sheet.

The filler particles used in the invention may be particles selected from the group including calcium carbonate, titanium dioxide, inorganic pigments, carbon black, clay, mica, talc, hydrotalcites, magnesium hydroxides, silica, silicates, hollow silicate spheres, wollastonite, feldspar, kaolin, glass spheres, synthetic carbonates, magnesium carbonate, barium carbonate, magnesium sulfate, barium sulfate, calcium sulfate, aluminum hydroxide, calcium oxide, magnesium oxide, alumina, asbestos powder, glass powder, or zeolite.

It is believed that a wide range of filler materials would be suitable for use in the invention because the fillers that have been demonstrated to be effective are inorganic fillers that do not interact chemically with the flash-spun polyolefin sheet material. Without being limited to a particular theory, it is believed that the filler particles break up the bundles of fibers within the flash-spun sheet, thus forming finer fibers. The result is that the number of small pores is increased, increasing the breathability of the sheet, but the number and the size of large pores are not increased or in some cases may be decreased, resulting in at least maintaining liquid barrier properties of conventional flashspun polyolefin sheets.

A filler that has been found to be an especially beneficial additive in flash-spun polyolefin sheets is calcium carbonate. The addition of a moderate amount of calcium carbonate to a polyolefin polymer prior to beginning flash-spinning according to the process described above has been found to significantly increase the breathability of the bonded flash-spun sheet. In a process for making such sheets, a mixture of a polyolefin polymer and calcium carbonate is first formed wherein the calcium carbonate comprises between about 12% and 20% by weight of the mixture. This mixture is combined with a solvent to form a spin solution at an elevated temperature and pressure. The pressure of the spin solution is greater than autogenous pressure, and preferably greater than the cloud-point pressure for the solution. The solvent preferably has an atmospheric boiling point between 0° C. and 150° C., and is selected from the group consisting of hydrocarbons, hydrofluorocarbons, chlorinated hydrocarbons, halocarbons, hydrochlorofluorocarbons, alcohols, ketones, acetates, hydrofluoroethers, perfluoroethers, and cyclic hydrocarbons (having five to twelve carbon atoms). Preferred solvents for solution flash-spinning polyolefin polymers and copolymers and blends of such polymers and copolymers include trichlorofluoromethane, methylene chloride, dichloroethylene, cyclopentane, pentane, dichlorofluoroethane (HCFC-141b) and bromochloromethane. Preferred co-solvents that may be used in conjunction with these solvents include hydrofluorocarbons such as decafluoropentane (HFC-4310mee), hydrofluoroethers such as methyl(perfluorobutyl)ether, and perfluorinated compounds such as perfluoropentane and perfluoro-N-methylmorpholine. This spin solution is subsequently flash-spun from a spin orifice and laid down on a moving belt to form sheets of plexifilamentary film-fibrils according to the flash-spinning process described above.

In one embodiment of the invention, polyethylene is the polyolefin in the mixture of calcium carbonate and polyolefin. The calcium carbonate is preferably added to the mixture in the form of particles having an average particle size of between 0.5 and 10 micrometers, preferably between 1 and 5 micrometers. Suitable particles are obtained by a precipitation process.

Flash-spun sheets of plexifilamentary film-fibrils of polyethylene and calcium carbonate have been found to exhibit significantly higher breathability than a sheet that is identical, except that it is made without calcium carbonate.

The sheet materials of the present invention are useful in applications where breathability and liquid barrier properties are important, such as in medical garments, where the breathability is important to provide comfort for the wearer and liquid barrier properties are important to keep bodily fluids and other liquids from reaching the wearer.

The following examples demonstrate that a sheet according to the invention is more breathable, without sacrificing liquid barrier, than sheet previously know in the art. The improvements that are realized with the present invention are made more apparent in the following non-limiting examples.

Test Methods

In the description above and in the non-limiting examples that follow, the following test methods were employed to determine various reported characteristics and properties. ASTM refers to the American Society for Testing and Materials, TAPPI refers to the Technical Association of the Pulp and Paper Industry, ISO refers to the International Organization for Standardization, and ANSI refers to the American National Standards Institute.

Hydrostatic Head (HH) is a measure of the resistance of the sheet to penetration by liquid water under a static load.

A 17.78 cm by 17.78 cm sample (7 inch by 7 inch) is mounted in a SDL 18 Shirley Hydrostatic head tester (manufactured by Shirley Developments Limited, Stockport, England). Water is pumped against one side of a 102.6 sq. cm. section of the sample at a rate of 60+/−3 cm per minute until the water penetrates three areas of the sample. The hydrostatic head is measured in inches. The test generally follows ASTM D 583, hereby incorporated by reference, which was withdrawn from publication in November, 1976. A higher number indicates a product with greater resistance to liquid passage.

Moisture Vapor Transmission Rate (MVTR) is reported in $g/m^2/24$ hrs and was measured with a Lyssy Instrument using test method TAPPI T-523, hereby incorporated by reference.

Basis Weight was determined by ASTM D-3776, which is hereby incorporated by reference, and is reported in $oz/yd^2$. The basis weights reported for the examples below are each based on an average of at least twelve measurements made on the sheet.

Delamination Strength of a sheet sample is measured using a constant rate of extension tensile testing machine such as an Instron table model tester. A 1.0 in. (2.54 cm) by 8.0 in. (20.32 cm) sample is delaminated approximately 1.25 in (3.18 cm) by inserting a pick into the cross-section of the sample to initiate a separation and delamination by hand. The delaminated sample faces are mounted in the clamps of the tester, which are set 1.0 in (2.54 cm) apart. The tester is started and run at a cross-head speed of 5.0 in/min (12.7 cm/min). The computer starts picking up force readings after the slack is removed in about 0.5 in. of crosshead travel. The sample is delaminated for about 6 in (15.24 cm) during which 3000 force readings are taken and averaged. The average delamination strength is the average force divided by the sample width and is expressed in units of lb/in. The test generally follows the method of ASTM D 2724-87, which is hereby incorporated by reference. The delamination strength values reported for the examples below are each based on an average of at least twelve measurements made on the sheet.

Opacity is measured according to TAPPI T-425 om-91, which is hereby incorporated by reference. The opacity is a measure of the amount of light reflected from a single sheet placed over a black background divided by the same measure of the amount of light reflected from the same sheet placed over a white background, which value is multiplied by 100 to obtain the percent opacity. The opacity values reported for the examples below are each based on an average of at least six measurements made on the sheet.

Tensile strength was determined by ASTM D 5035-90, which is hereby incorporated by reference, with the following modifications. In the test, a 2.54 cm by 20.32 cm (1 inch by 8 inch) sample was clamped at opposite ends of the sample. The clamps were attached 12.7 cm (5 in) from each other on the sample. The sample was pulled steadily at a speed of 5.08 cm/min (2 in/min) until the sample broke. The force at break was recorded in newtons/cm as the breaking tensile strength.

Gurley Hill Porosity is a measure of the permeability of the sheet material for gaseous materials. In particular, it is a measure of how long it takes for a volume of gas to pass through an area of material wherein a certain pressure gradient exists. Gurley-Hill porosity is measured in accordance with ASTM D 726-84 using a Lorentzen & Wettre Model 121D Densometer. This test measures the time required for 100 cubic centimeters of air to be pushed through a one-inch (2.54-centimeter) diameter sample under a pressure of approximately 4.9 inches of water (1219 pascals). The result is expressed in seconds and is frequently referred to as Gurley Seconds.

EXAMPLES

Comparative Example 1

Plexifilamentary polyethylene was flash-spun from a solution consisting of 18.5% of linear high density polyethylene and 81.5% of spin agent consisting of 29% cyclopentane and 71% normal pentane. The polyethylene had a melt index of 0.70 grams/10 minutes (@190° C. with a 2.16 kg weight), a melt flow ratio {MI(@190° C. with a 2.16 kg weight)/MI(@190° C. with a 21.6 kg weight)} of 34, and a density of 0.96 g/cc. The polyethylene was obtained from the Equistar Chemical Company of Houston, Tex. under the trade name Alathon®. Alathon® is currently registered trademark of the Equistar Chemical Company. The solution was prepared in a continuous mixing unit and delivered at a temperature of 185° C. and a pressure of about 13.8 MPa (2000 psi) through a heated transfer line to an array of six spinning positions. Each spinning position had a pressure let down chamber where the solution pressure dropped to about 6.75 MPa (980 psi). The solution discharged from each letdown chamber to a region maintained near atmospheric pressure and at a temperature of 50° C. through a 0.871 mm (0.0343 in) spin orifice. The flow rate of the solution through each orifice was about 131 kg/hr (289 lbs/hr). The solution was flash-spun into plexifilamentary film-fibrils that were laid down on a moving belt, consolidated, and collected as a loosely consolidated sheet on a take-up roll as described above. The as spun basis weight was 54.2 $g/m^2$ (1.6 $oz/yd^2$).

The sheet was bonded on a Palmer bonder by passing the sheet between a moving belt and a rotating smooth metal drum with a diameter of about 5 feet (1.52 meters) heated to a surface temperature in the range of about 133 to 137° C. Test results are set forth in Table 1.

Comparative Example 2

This example was made under conditions like those described in the Comparative Example 1 with the exception that calcium carbonate was added to the polyethylene before the polyethylene was added to the solvent. The calcium carbonate had a top cut particle size of 1 micrometer. A concentrate was formed by blending the calcium carbonate with the Alathon® resin described earlier as a 50% (w/w) blend. This concentrate was obtained from the Equistar Colors and Concentrate business, which has been acquired by the Ampacet Corporation of Tarrytown, N.Y. The concentrate was subsequently tumble blended with a quantity of high density polyethylene used in Comparative Example 1. The resulting mixture was comprised of 95% polyethylene and 5% calcium carbonate. The mixture was added to the same spin solution as in Comparative Example 1 at 18.8% concentration to form a spin solution. The spin solution was subsequently flash-spun under conditions identical to Comparative Example 1 to produce a consolidated sheet. The sheet was thermally bonded on a Palmer bonder as described in Comparative Example 1. Test results are set forth in Table 1.

Comparative Example 3

This example was made as described in Comparative Example 2 with the exception that the high density polyethylene and the calcium carbonate mixture was comprised of 90% polyethylene and 10% calcium carbonate. The mixture was added to the spin agent to form a spin solution with an 18.2% concentration. Test results are set forth in Table 1.

Example 4

This example was made as described in Comparative Example 2 with the exception that the high density polyethylene and the calcium carbonate mixture was comprised of 85% polyethylene and 15% calcium carbonate. The mixture was added to the spin agent to form a spin solution with a 21.5% concentration. Test results are set forth in Table 1.

Example 5

This example was made as described in Comparative Example 2 with the exception that the high density polyethylene and the calcium carbonate mixture was comprised of 80% polyethylene and 20% calcium carbonate. The mixture was added to the spin agent to form a spin solution with an 18.7% concentration. Test results are set forth in Table 1.

Comparative Example 6

This example was made as described in Comparative Example 2 with the exception that the high density polyethylene and the calcium carbonate mixture was comprised of 90% polyethylene and 10% calcium carbonate and the calcium carbonate had an average particle size of 5 micrometers. The mixture was added to the spin agent to form a spin solution with a 17.6% concentration. Test results are set forth in Table 1.

Comparative Example 7

This Comparative Example was made the same as Comparative Example 1 with the exception that the concentration of the spinning solution was 18.1% and the as spun basis weight was 74.6 g/m$^2$ (2.2 oz/yd$^2$). Test results are set forth in Table 1.

Comparative Example 8

This example was made as described in the Comparative Example 2 with the exception that the concentration of the spinning solution was 17.8% and the as spun basis weight was 74.6 g/m$^2$ (2.2 oz/yd$^2$). Test results are set forth in Table 1.

Comparative Example 9

This example was made as described in Comparative Example 3 with the exception that the as spun basis weight was 74.6 g/m$^2$ (2.2 oz/yd$^2$). Test results are set forth in Table 1.

Example 10

This example was made as described in Example 4 with the exception that the concentration of the spinning solution was 20.6% and the as spun basis weight was 74.6 g/m$^2$ (2.2 oz/yd$^2$). Test results are set forth in Table 1.

Example 11

This example was made as described in Example 5 with the exception that the as spun basis weight was 74.6 g/m$^2$ (2.2 oz/yd$^2$). Test results are set forth in Table 1.

Comparative Example 12

This example was made as described in Comparative Example 6 with the exception that the concentration of the spinning solution was 17.5% and the as spun basis weight was 74.6 g/m$^2$ (2.2 oz/yd$^2$). Test results are set forth in Table 1.

TABLE 1

| Example No. | Polymer Solution Conc. (wt %) | % Filler Added (wt %) | Opacity (%) | Gurley Hill (sec) | HH (cm) | Tensile/ (N/cm) | MVTR (g/m$^2$/day) | Delam. Strength (N/cm) | BW (g/m$^2$) |
|---|---|---|---|---|---|---|---|---|---|
| Comp. Ex. 1 | 18.5 | 0 | 98.6 | 43.8 | 185.4 | 63.7 | 1350 | 0.63 | 59.0 |
| Comp. Ex. 2 | 18.8 | 5 | 98.0 | 40.8 | 213.4 | 67.2 | 1580 | 0.65 | 57.3 |
| Comp. Ex. 3 | 18.2 | 10 | 95.2 | 20.2 | 184.7 | 64.2 | 1560 | 0.61 | 56.9 |
| 4 | 21.5 | 15 | 95.6 | 22.9 | 158.5 | 51.5 | 1600 | 0.61 | 60.0 |
| 5 | 18.7 | 20 | 93.0 | 7.50 | 210.8 | 48.1 | 1870 | 0.61 | 54.2 |
| Comp. Ex. 6 | 17.6 | 10 | 96.8 | 23.7 | 200.2 | 57.9 | 1740 | 0.61 | 58.6 |
| Comp. Ex. 7 | 18.1 | 0 | 99.0 | 125 | 240.0 | 95.9 | 1200 | 0.61 | 79.6 |
| Comp. Ex. 8 | 17.8 | 5 | 99.1 | 89.7 | 248.4 | 91.7 | 1190 | 0.61 | 77.3 |
| Comp. Ex. 9 | 18.2 | 10 | 97.9 | 45.3 | 235.5 | 85.6 | 1720 | 0.61 | 78.0 |
| 10 | 20.6 | 15 | 97.7 | 33.8 | 244.9 | 79.8 | 1490 | 0.61 | 77.3 |
| 11 | 18.7 | 20 | 95.6 | 21.0 | 213.4 | 72.1 | 1550 | 0.61 | 75.9 |
| Comp. Ex. 12 | 17.5 | 10 | 97.5 | 48.7 | 201.7 | 77.7 | 1510 | 0.61 | 75.6 |

The data in Table 1 shows that sheet made containing the filler in an amount greater than about 11 wt % had improved breathability, as indicated by lower Gurley Hill porosity. Surprisingly, the improvement in breathability was achieved without an unacceptable loss in hydrostatic head in any of the examples.

Comparative Example 13

Plexifilamentary polyethylene was flash-spun from a solution consisting of 18% of linear high density polyethylene and 82% of spin agent consisting of 29% cyclopentane and 71% normal pentane. The polyethylene had a melt index of 0.70 grams/10 minutes (@190° C. with a 2.16 kg weight), a melt flow ratio {MI (@190° C. with a 2.16 kg weight)/MI (@190° C. with a 21.6 kg weight)} of 34, and a density of 0.96 g/cc. The polyethylene was obtained from the Equistar Chemical Company of Houston, Tex. under the trade name Alathon®. Alathon® is Alathon® is currently registered trademark of the Equistar Chemical Company. The solution was prepared in a continuous mixing unit and delivered at a temperature of 185° C. and a pressure of about 13.8 MPa (2000 psi) through a heated transfer line to an array of six spinning positions. Each spinning position had a pressure let down chamber where the solution pressure dropped to about 6.75 MPa (980 psi). The solution discharged from each letdown chamber to a region maintained near atmospheric pressure and at a temperature of 50° C. through a 0.871 mm (0.0343 in) spin orifice. The flow rate of the solution through each orifice was about 131 kg/hr (289 lbs/hr). The solution was flash-spun into plexifilamentary film-fibrils that were laid down on a moving belt, consolidated, and collected as a loosely consolidated sheet on a take-up roll as described above. The as spun basis weight was 68.1 g/m$^2$ (1.6 oz/yd$^2$). The sheet was bonded on a Palmer bonder by passing the sheet between a moving belt and a rotating smooth metal drum with a diameter of about 5 feet (1.52 meters) heated to a surface temperature in the range of about 133 to 137° C. Test results are set forth in Table 2.

Comparative Example 14

This example was made as described in Comparative Example 13 with the exception that the titanium dioxide was added to the polyethylene before the polyethylene was added to the solvent. The titanium dioxide had a particle size of 0.29. A concentrate was formed by blending the titanium dioxide with the polyethylene as a 60/40% (w/w) blend. This concentrate was obtained from Ampacet Corporation of Tarrytown, N.Y. The concentrate was subsequently tumble blended with a quantity of the high density polyethylene used in Comparative Example 13 and the resultant titanium dioxide mixture was comprised of 94.2% polyethylene and 5.8% titanium dioxide. The mixture was added to the spin agent to form a spin solution with an 18% concentration. Test results are set forth in Table 2.

Example 15

This example was made as described in Comparative Example 14 with the exception that the high density polyethylene and the titanium dioxide Example 15

This example was made as described in Comparative Example 14 with the exception that the high density polyethylene and the titanium dioxide mixture was comprised of 83.2% polyethylene and 16.7% titanium dioxide. Test results are set forth in Table 2.

Example 16

This example was made as described in Comparative Example 14 with the exception that the high density polyethylene and the titanium dioxide mixture was comprised of 66.7% polyethylene and 33.3% titanium dioxide. Test results are set forth in Table 2.

TABLE 2

| Example No. | Polymer Solution Conc. (wt %) | % Filler Added (wt %) | Opacity (%) | Gurley Hill (sec) | HH (cm) | Tensile (N/cm) | MVTR (g/m$^2$/day) | Delam. Strength (N/cm) | BW (g/m$^2$) |
|---|---|---|---|---|---|---|---|---|---|
| Comp. Ex. 13 | 18.0 | 0 | 94.35 | 20.95 | 173.5 | 84.1 | NR | 0.875 | 68.1 |
| Comp, Ex 14 | 18.0 | 5.8 | 96.2 | 19.5 | 149.6 | 70.7 | NR | 1.05 | 67.8 |
| 15 | 18.0 | 16.7 | 98.0 | 17.3 | 158.8 | 70.4 | NR | 1.07 | 71.5 |
| 16 | 18.0 | 33.3 | 98.5 | 7.7 | 161.0 | 60.2 | NR | 1.17 | 69.8 |

Although particular embodiments of the present invention have been described in the foregoing description, it will be understood by those skilled in the art that the invention is capable of numerous modifications, substitutions and rearrangements without departing from the spirit or essential attributes of the invention. Reference should be made to the appended claims, rather than to the foregoing specification, as indicating the scope of the invention.

What is claimed is:

1. A nonwoven fibrous sheet comprising: continuous lengths of plexifilamentary flim-fibril strands of a polymer capable of being flash spun and a filler wherein the filler is titanium dioxide comprising between about 16 and 33% by weight of the plexifilamentary film-fibril strands.

2. The sheet claim 1, wherein the sheet has a Gurtey Hill porosity of less than about 18 seconds, a basis weight of up to about 2.1 oz/yd$^2$ (71.5 g/m$^2$) and a hydrostatic head of greater than about 62 inches (157 cm).

* * * * *